US010227215B2

(12) United States Patent
Park

(10) Patent No.: US 10,227,215 B2
(45) Date of Patent: Mar. 12, 2019

(54) PASSENGER CONVEYOR AND METHOD FOR MONITORING VIBRATIONS IN A PASSENGER CONVEYOR

(71) Applicant: Otis Elevator Company, Farmington, CT (US)

(72) Inventor: Chan-Jong Park, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/684,387

(22) Filed: Aug. 23, 2017

(65) Prior Publication Data

US 2018/0057315 A1 Mar. 1, 2018

(30) Foreign Application Priority Data

Aug. 24, 2016 (EP) ..... 16185495

(51) Int. Cl.
*B66B 25/00* (2006.01)
*B66B 27/00* (2006.01)

(52) U.S. Cl.
CPC ..... *B66B 25/006* (2013.01); *B66B 27/00* (2013.01)

(58) Field of Classification Search
CPC ..... B66B 23/18; B66B 25/006; B66B 27/00; B65G 23/44; B65G 43/02
USPC ..... 198/323, 329, 502.1, 810.04
See application file for complete search history.

(56) References Cited

U.S. PATENT DOCUMENTS

| | | | | |
|---|---|---|---|---|
| 8,636,140 | B2 * | 1/2014 | Tout | B65G 23/44 198/814 |
| 9,776,803 | B2 * | 10/2017 | Rimmington | E21F 13/06 |
| 2017/0297874 | A1 * | 10/2017 | Borthakur | B66B 25/006 |

FOREIGN PATENT DOCUMENTS

| | | | |
|---|---|---|---|
| CN | 101337639 | B | 6/2010 |
| CN | 101264842 | B | 8/2011 |
| CN | 203199865 | U | 9/2013 |
| CN | 104310138 | A | 1/2015 |
| CN | 102674129 | B | 3/2015 |
| CN | 204224067 | U | 3/2015 |
| JP | H0455290 | A | 2/1992 |
| JP | H0489791 | * | 3/1992 |
| JP | H0489791 | A | 3/1992 |
| JP | 2001240357 | A | 9/2001 |
| JP | 3430197 | B2 | 7/2003 |
| JP | 4791093 | B2 | 10/2011 |

(Continued)

OTHER PUBLICATIONS

European Search Report for application EP1618549.5, dated Feb. 10, 2017, 8pgs.

(Continued)

*Primary Examiner* — Gene O Crawford
*Assistant Examiner* — Keith R Campbell
(74) *Attorney, Agent, or Firm* — Cantor Colburn LLP

(57) ABSTRACT

A passenger conveyor (1) comprises at least one transport chain (6) connected to a plurality of transportation elements (4) which are configured for travelling in a closed loop along a pathway; at least one sensor (24), which is arranged in a non-straight portion of the pathway and which is configured for detecting a varying force (F') exerted by the transport chain (6) and/or by the transportation elements (4) in a direction oriented transversely, in particular orthogonally, to a travelling direction of the transportation elements (4); and a calculation and alarm unit (26).

17 Claims, 2 Drawing Sheets

(56) References Cited

FOREIGN PATENT DOCUMENTS

Figure 1:
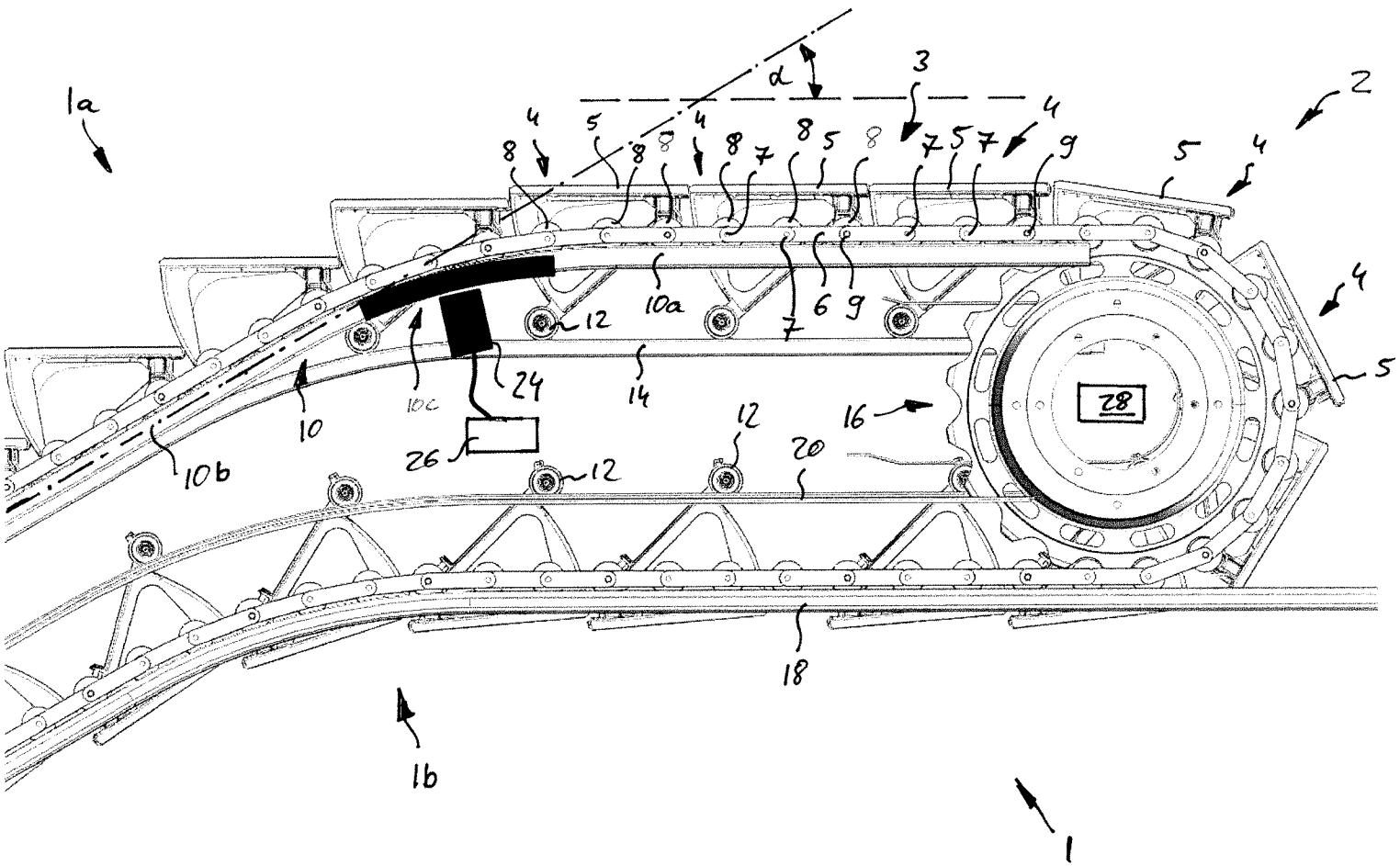

| | | | |
|---|---|---|---|
| JP | 2014227272 | A | 12/2014 |
| JP | 5825989 | B2 | 12/2015 |
| WO | 2005015326 | A1 | 2/2005 |

OTHER PUBLICATIONS

Kiang, Chung Chau Nefield, "Condition monitoring of escalator system using fibre bragg grating sensors and signal processing techniques : a case study of public service escalators", Abstract, Hong Kong Polytechnic University Pao Yue-kong Library, 2013, 3pgs.

Kiang, Nefield C.C., et al., "Application of WPT and FBG techniques for prognostic of escalator abnormality: a case study of degraded step wheel", HKIE Transactions, 2014, 14 pgs.

Schindler Elevator Corporation, "Operation & Maintenance Manual Schindler 9700™ Escalators", Foggy Bottom Station, 2012, 516pgs.

* cited by examiner

PASSENGER CONVEYOR AND METHOD FOR MONITORING VIBRATIONS IN A PASSENGER CONVEYOR

The invention relates to a passenger conveyor, in particular to a passenger conveyor which allows for remotely detecting vibrations associated with the operation of the passenger conveyor.

Due to the polygonal effect and for other reasons, vibrations occur during the operation of a passenger conveyor, such as an escalator or a moving walkway. Due to wear of the components of the passenger conveyor, these vibrations increase with increasing time of operation. The increasing vibrations derogate the ride comfort of the passengers using the passenger conveyor. Strong vibrations further result in additional wear or even damage of the components of the passenger conveyor. Thus, frequent inspection and maintenance of the passenger conveyor is needed for restricting the vibrations to an acceptable level.

It therefore would be beneficial if the vibrations occurring during the operation of a passenger conveyor could be detected automatically without a mechanic being on-site.

According to an exemplary embodiment of the invention a passenger conveyor comprises: at least one transport chain connected to a plurality of transportation elements which are configured for travelling in a closed loop along a pathway of the conveyor; at least one sensor, which is arranged in a non-straight portion of the pathway and which is configured for detecting a varying force exerted by the transport chain and/or by the transportation elements in a direction oriented transversely, in particular orthogonal, to a travelling direction of the transportation elements; and a calculation and alarm unit. The calculation and alarm unit is configured for determining an amplitude of the varying force detected by the sensor, for comparing the determined amplitude, or a quantity derived from said amplitude, with a predetermined threshold value, and for issuing an alarm signal in case the calculated amplitude, or the quantity derived from said amplitude, exceeds the predetermined threshold value.

According to an exemplary embodiment of the invention a method for monitoring vibrations in a passenger conveyor, which comprises a transport chain connecting a plurality of transportation elements which are configured for travelling in a closed loop along a pathway of the conveyor, includes the steps of: detecting a varying force exerted by the transport chain and/or by the transportation elements in a direction which is oriented transverse to the travelling direction in a non-straight portion of the pathway; determining the amplitude of the varying detected force; and comparing the amplitude, or a quantity derived from said amplitude, with a predetermined threshold value and issuing an alarm signal in case the amplitude, or the quantity derived from said amplitude, exceeds the predetermined threshold value.

Exemplary embodiments of the invention allow to detect vibrations, which are associated with the operation of a passenger conveyor, automatically and remotely without a mechanic being present at the site of the conveyor. In consequence, a mechanic needs to visit the passenger conveyor only after vibrations exceeding a predetermined threshold have been detected and an alarm signal has been issued. As a result, the costs for inspection and maintenance may be considerably reduced. Additionally, the riding comfort of the passenger may be enhanced, as excessive vibrations may be detected earlier and more reliably.

In the following exemplary embodiments of the invention are described with reference to the enclosed figures.

Figure 2:
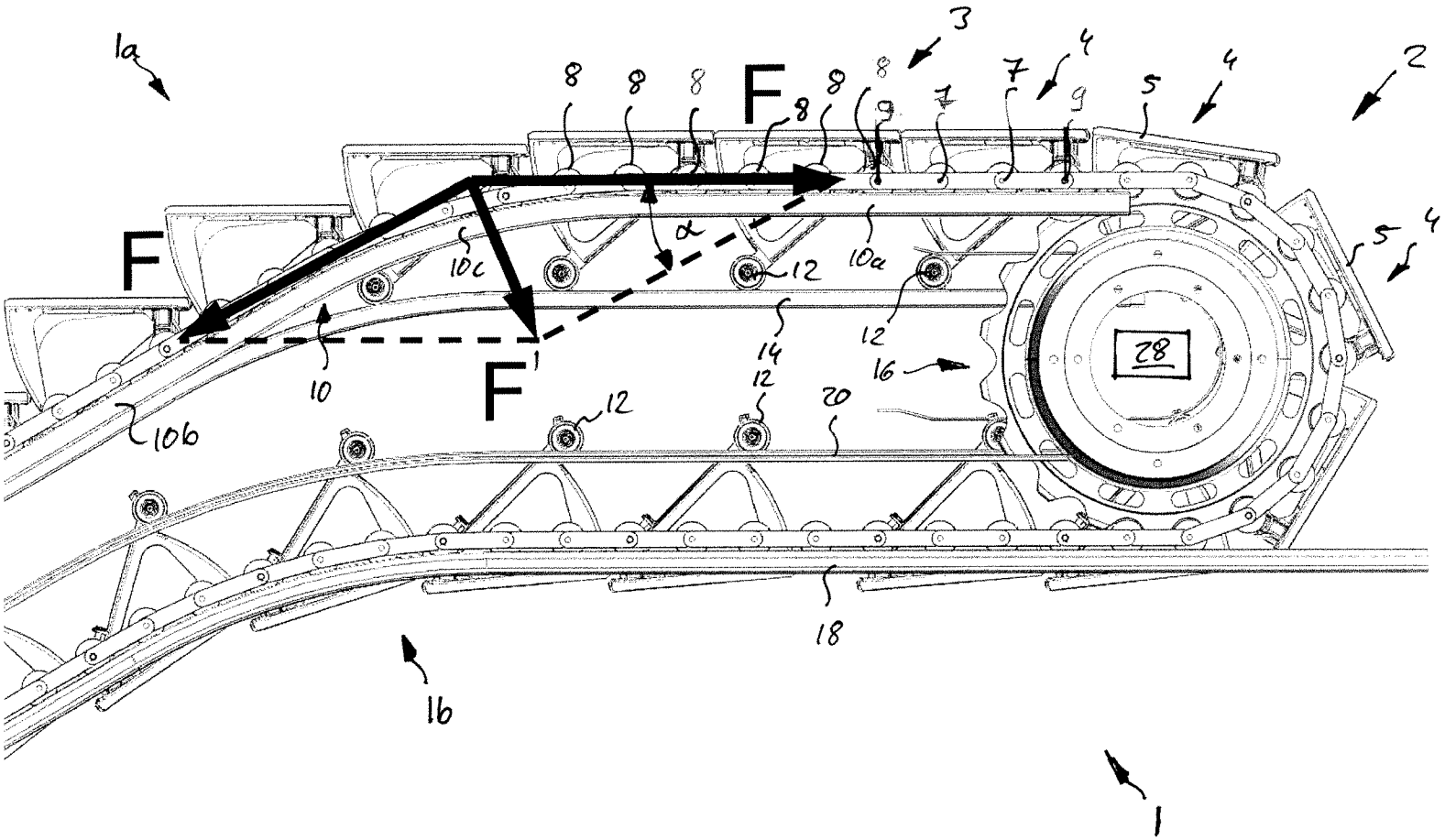

FIGS. 1 and 2 respectively show a side view of an upper turnaround portion 2 of a passenger conveyor 1 comprising a plurality of transportation elements 4. The transportation elements 4 are connected to a transport chain 6 comprising a plurality of links and travelling in a closed loop along a transportation pathway. Only the upper portion of said pathway (the portion next to upper turnaround portion 2) is shown in FIGS. 1 and 2.

In the exemplary embodiment shown in FIGS. 1 and 2, the passenger conveyor 1 is an escalator in which the transportation elements 4 are provided in the form of steps and the transport chain 6 is provided in the form of a step chain 6. Each step 4 comprises a tread 5 which is configured for supporting passengers using the passenger conveyor 1.

The principle of the invention also can be applied to moving walkways comprising a plurality of pallets instead of steps.

A plurality of step chain rollers 8 are arranged at the joints 7, 9 connecting the links of the step chain 6. In the example shown in the Figures, every third joint 9 is connected to a corresponding step 4. Other configurations, for example a configuration in which every second joint 9 is connected to a corresponding step 4, are possible as well.

In an upper transportation portion 1*a* of the passenger conveyor 1, the step chain rollers 8 are supported by an upper step chain roller guide rail 10. In a lower return portion 1*b* of the passenger conveyor 1, the step chain rollers 8 are supported by a lower step chain roller guide rail 18.

Additional step rollers 12 are provided at lower ends of the steps 4. The step rollers 12 are guided and supported by an upper step roller guide rail 14 in the upper transportation portion 1*a* and by lower step roller guide rail 20 in the lower return portion 1*b* of the passenger conveyor 1.

The step chain 6 is guided from the upper transportation portion 1*a* into the lower return portion 1*b* (or vice versa) by means of a sprocket 16 comprising teeth which engage with the step chain rollers 8. The sprocket 16 may be driven by a drive including a motor (not shown) for driving the passenger conveyor 1.

In an upper landing portion 3 of the passenger conveyor 1, in which the treads 5 of the steps 4 are arranged in a common horizontal plane, the upper step chain roller guide rail 10 extends horizontally forming a horizontal portion 10*a* of the upper step chain roller guide rail 10.

The upper step chain roller guide rail 10 further comprises an inclined portion 10*b*, which is inclined at an angle $\alpha$ with respect to the horizontal for spanning a vertical distance between a lower turnaround portion (not shown) and the upper turnaround portion 2 of the passenger conveyor 1.

A non-straight (curved) intermediate portion 10*c* of the upper step chain roller guide rail 10 connects the horizontal portion 10*a* with the inclined portion 10*b*. The curved intermediate portion 10*c* guides the step chain 6 along a curved pathway from the inclined portion 10*b* into the horizontal portion 10*a* of the upper step chain roller guide rail 10 and/or vice versa.

A sensor 24 is arranged at the intermediate portion 10*c* of the upper step chain roller guide rail 10. The sensor 24, which in particular may include a load cell, is configured for measuring a varying force F' or a pressure which is exerted by the step chain 6 onto the step chain roller guide rail 10 in a direction which is oriented orthogonally to the extension of the upper step chain roller guide rail 10.

The sensor 24 is electrically connected to a calculation and alarm unit 26, which is configured for evaluating the signals provided by the sensor 24.

FIG. 2 schematically depicts the varying force F' measured by the sensor 24 and a parallelogram of forces illustrating that the force F acting in the conveying direction of the step chain 6 may be calculated from the measured varying force F' by formula (1):

$$F=F'/(2*\sin(\alpha/2)) \quad (1).$$

When the masses mstep of the steps 4 and the masses mP of the passengers riding on the passenger conveyor 1 at the time of the measurement are known, the momentary acceleration a of the step chain rollers 8, step chain 6 and the steps 4 in the conveying direction may be calculated from said force F using formulas (2a) and (2b):

$$i.\ a=F/(m\text{step}+mP) \quad (2a).$$

$$ii.\ a=F'/\{(m\text{step}+mP)*(2\ \sin(\alpha/2))\} \quad (2b).$$

The constant mass mstep of each of the steps 4, which also includes the masses of the step chain rollers 8, step rollers 12 and the links of the step chain 6 associated with the each of the steps 4, is known. Since more energy (a larger force) is needed for driving the sprocket 16 when passengers are standing on the steps 4, the masses mP of the passengers riding on the steps 4 may be calculated from the momentary driving force (energy) necessary for driving the sprocket 16, which may be detected from a driving force sensor 28.

Due to the polygonal effect, which is caused by the periodic engagement and disengagement of the links of the step chain 6 with the sprocket 16 when the sprocket 16 is rotated, the forces F' and F as well as the acceleration a of the steps 4 oscillates as a function of time.

The calculation and alarm unit 26 is configured for measuring the maximum amplitude (peak to peak value of the acceleration a) Δa and for comparing said maximum amplitude Δa with a predetermined threshold aT.

In case the amplitude Δa, which has been calculated from the measured varying force F' according to formula (2b), exceeds the predetermined threshold aT1 for more than a predefined first period of time T1, e.g. for a predetermined number of periods of the oscillation, the calculation and alarm unit 26 issues an alarm signal requesting inspection and/or maintenance of the passenger conveyor 1.

Alternatively, the calculation and alarm unit 26 may evaluate the amplitude Δa for predetermined time intervals, e.g. intervals of 10 s to 60 s, and issue an alarm signal in case the amplitude Δa exceeds the predetermined threshold aT1 for more than a predetermined number of times T1 within said time interval.

Additionally or alternatively, the calculation and alarm unit 26 may stop further operation of the passenger conveyor 1 in case the predetermined threshold aT is exceeded for more than a predetermined second period of time T2, which may be equal to or larger than the first period of time T1, or the calculated acceleration exceeds a predetermined second threshold aT2 for more than the predetermined second period of time T2. Stopping further operation of the escalator avoids damage and excessive wear of the components of the passenger conveyer 1, which may be caused by excessive vibrations.

A number of optional features are set out in the following. These features may be realized in particular embodiments, alone or in combination with any of the other features.

In one embodiment the calculation and alarm unit may be configured for issuing the alarm signal only in case the calculated amplitude, or the quantity derived from said amplitude, exceeds the predetermined threshold value for at least a predetermined amount of time and/or for at least a predetermined number of times. This reduces the risk of false alarms caused by a single random excess of the predetermined threshold value.

In one embodiment the calculation and alarm unit may evaluate the amplitude for predetermined time intervals, e.g. intervals of 10 s to 60 s, and issue an alarm signal in case the amplitude exceeds the predetermined threshold aT1 for more than a predetermined number of times within said time interval. This also reduces the risk of false alarms caused by a single random excess of the predetermined threshold value.

In one embodiment the at least one sensor may be arranged in a curved intermediate portion of the pathway, in particular at the center of an intermediate portion of the pathway which is located between an inclined portion of the conveyor and a horizontal (landing) portion of the conveyor. Arranging the at least one sensor in said curved intermediate portion of the pathway allows for a reliable detection of vibrations, in particular of vibrations along the conveying direction, in particular including vibrations caused by the polygonal effect.

In one embodiment the calculation and alarm unit may be configured for calculating a component of the force which is oriented parallel to the travelling direction. This allows detecting vibrations along the conveying direction, in particular vibrations caused by the polygonal effect.

In one embodiment the calculation and alarm unit may be configured for calculating an acceleration of the transportation elements from the calculated component of the force which is oriented parallel to the travelling direction. The calculation and alarm unit further may be configured for comparing the calculated acceleration of the transportation elements with a predetermined threshold value. Calculating the acceleration of the transportation elements in particular may include considering the mass of the transportation elements and the masses of passengers residing on the transportation elements. Taking the mass of the transportation elements and the masses of passengers into account allows to reduce the risk of false alarms caused by variations of the vibration amplitudes resulting from varying loads on the passenger conveyor.

In one embodiment the passenger conveyor may comprise a driving force sensor, which is configured for determining the driving force needed for driving the transportation elements along the conveying direction. The calculation and alarm unit in particular may be configured for determining the masses of passengers residing on the transportation elements from said determined driving force. The driving force sensor in particular may include a current sensor which is configured for measuring the electrical current needed for driving the passenger conveyor. Such a driving force sensor allows to determine the masses of passengers residing on the transportation elements easily and with sufficient accuracy.

In one embodiment the passenger conveyor may be an escalator in which the transportation elements are provided in the form of steps.

In one embodiment the passenger conveyor may be a moving walkway in which the transportation elements are provided in the form of pallets. The moving walkway may be inclined for transporting passengers between different levels of height, or it may extend horizontally along a constant level of height.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the dependent claims.

REFERENCES

1 passenger conveyor
1*a* upper transportation portion
1*b* lower return portion
2 upper turnaround portion
3 upper landing portion
4 transportation element
5 tread
6 transport chain/step chain
7 joint of the transport chain
8 step chain roller
9 joint of the transport chain
10 upper step chain roller guide rail
10*a* horizontal portion of the upper step chain roller guide rail
10*b* inclined portion of the upper step chain roller guide rail
10*c* intermediate portion of the upper step chain roller guide rail
12 step roller
14 upper step roller guide rail
16 sprocket
18 lower step chain roller guide rail
20 lower step roller guide rail
24 sensor
26 calculation and alarm unit
28 driving force sensor

What is claimed is:

1. Passenger conveyor comprising:

at least one transport chain connected to a plurality of transportation elements which are configured for travelling in a closed loop along a pathway;

at least one sensor, which is arranged in a non-straight portion of the pathway and which is configured for detecting a varying force (F') exerted by the transport chain and/or by the transportation elements in a direction oriented transversely to a travelling direction of the transportation elements; and a calculation and alarm unit, which is configured for determining an amplitude (Δa) of the varying force (F') detected by the sensor; and which is configured for comparing the determined amplitude (Δa), or a quantity derived from said amplitude (Δa), with a predetermined threshold value (aT) and for issuing an alarm signal in case the calculated amplitude (Δa), or the quantity derived from said amplitude (Δa), exceeds the predetermined threshold value (aT).

2. Passenger conveyor according to claim 1, wherein the calculation and alarm unit is configured for issuing the alarm signal only in case the calculated amplitude (Δa), or the quantity derived from said amplitude (Δa), exceeds the predetermined threshold value (aT) for at least a predetermined amount of time (T) and/or for at least a predetermined number of times.

3. Passenger conveyor according to claim 1, wherein the at least one sensor is arranged in a curved intermediate portion of the pathway.

4. Passenger conveyor according to claim 1, wherein the calculation and alarm unit is configured for calculating a component of the force (F) which is oriented parallel to the travelling direction.

5. Passenger conveyor according claim 4, wherein the calculation and alarm unit is configured for calculating an acceleration (a) of the transportation elements from the calculated component of the force (F) oriented parallel to the travelling direction and for comparing the calculated acceleration (a) with the predetermined threshold value (aT).

6. Passenger conveyor according claim 5, wherein the calculation and alarm unit is configured for including the mass (mstep) of the transportation elements and the mass (mP) of passengers residing on the transportation elements when calculating the acceleration (a) of the transportation elements.

7. Passenger conveyor according claim 6, further comprising a driving force sensor which is configured for determining the driving force which is needed for driving the transportation elements, wherein the calculation and alarm unit is configured for determining the mass (mP) of passengers residing on the transportation elements from said driving force.

8. Passenger conveyor according to claim 1, wherein the passenger conveyor is an escalator in which the transportation elements are provided in the form of steps.

9. Passenger conveyor according to claim 1, wherein the passenger conveyor is a moving walkway in which the transportation elements are provided in the form of pallets.

10. Passenger conveyor according to claim 1, wherein the least one sensor is configured for detecting a varying force exerted by the transport chain and/or by the transportation elements in a direction oriented orthogonally to the travelling direction of the transportation elements.

11. Passenger conveyor according to claim 3, wherein the curved intermediate portion of the pathway is located between an inclined portion of the passenger conveyor and a horizontal landing portion of the passenger conveyor.

12. Method for monitoring vibrations in a passenger conveyor comprising a transport chain connecting a plurality of transportation elements which are configured for travelling in a closed loop along a pathway;

wherein the method includes detecting a varying force (F') exerted by the transport chain and/or by the transportation elements in a direction which is oriented transverse to the travelling direction in a non-straight portion of the pathway;

determining the amplitude (Δa) of the detected varying force (F');

comparing the amplitude (Δa), or a quantity derived from said amplitude (Δa), with a predetermined threshold value (aT) and issuing an alarm signal in case the amplitude (Δa), or the quantity derived from said amplitude (Δa), exceeds the predetermined threshold value (aT).

13. Method according to claim 12 wherein the alarm signal is issued only in case the amplitude (Δa), or the quantity derived from said amplitude (Δa), exceeds the predetermined threshold value (aT) for at least a predetermined amount of time (T) and/or for at least a predetermined number of times.

14. Method according to claim 12, further including calculating a component of the force (F) which is oriented parallel to the travelling direction.

15. Method according to claim 14, wherein the method further includes calculating an acceleration (a) of the transport chain from the calculated component of the force (F)

which is oriented parallel to the travelling direction and comparing the calculated acceleration (a) with the predetermined threshold value (aT).

16. Method according to claim 15, wherein the method further includes using the mass (mstep) of the transportation elements and the mass (mP) of passengers residing on the transportation elements when calculating the acceleration of the transportation elements.

17. Method according to claim 16, wherein the method includes determining the driving force which is needed for driving the transportation elements and determining the masses (mP) of passengers residing on the transportation elements from said driving force.

* * * * *